United States Patent [19]

Merkli

[11] Patent Number: 4,523,751

[45] Date of Patent: Jun. 18, 1985

[54] APPARATUS FOR CONVOLUTING SHEETS OF PAPER ON A CORE

[75] Inventor: Peter Merkli, Oftringen, Switzerland

[73] Assignee: GRAPHA-Holding AG, Hergiswil, Switzerland

[21] Appl. No.: 638,888

[22] Filed: Aug. 8, 1984

[30] Foreign Application Priority Data

Aug. 23, 1983 [CH] Switzerland ..... 4578/83

[51] Int. Cl.[3] ..... B65H 39/08; B65B 63/04

[52] U.S. Cl. ..... 270/60

[58] Field of Search ..... 270/60, 54; 271/315, 271/275; 53/430, 118; 242/59, 159

[56] References Cited

U.S. PATENT DOCUMENTS

| | | | |
|---|---|---|---|
| 3,957,220 | 5/1976 | Beck et al. | 242/59 X |
| 4,116,427 | 9/1978 | Muller | 270/54 |
| 4,434,948 | 3/1984 | Feldkamper | 242/59 |
| 4,438,618 | 3/1984 | Honegger | 242/59 |

FOREIGN PATENT DOCUMENTS

| | | | |
|---|---|---|---|
| 3221153 | 2/1983 | Fed. Rep. of Germany . | |
| 3231427 | 3/1983 | Fed. Rep. of Germany . | |
| 559691 | 3/1975 | Switzerland | 242/59 |
| 2092557 | 8/1982 | United Kingdom | 242/59 |

*Primary Examiner*—E. H. Eickholt

*Attorney, Agent, or Firm*—Peter K. Kontler

[57] ABSTRACT

Partly overlapping sheets of a scalloped stream of sheets are transported against one side of a flexible band which is being convoluted onto a first core so that the sheets form convolutions which alternate with the convolutions of the band. The latter is drawn off a second core which is coaxial with the first core, and such band is trained over a set of pulleys which cause it to advance substantially tangentially of and between the axial ends of the first core. The two cores can be driven and braked independently of one another and are mounted in a common frame. The second core is driven by a shaft which rotatably mounts the first core.

10 Claims, 2 Drawing Figures

APPARATUS FOR CONVOLUTING SHEETS OF PAPER ON A CORE

BACKGROUND OF THE INVENTION

The present invention relates to improvements in apparatus for temporary storage of paper sheets or the like, and more particularly to improvements in apparatus of the type wherein the sheets are stored between the convolutions of a flexible band which is convoluted around a rotary core. Still more particularly, the invention relates to improvements in apparatus of the type wherein one end of the flexible band is attached to the rotary core and the other end of the band is attached to a discrete second core.

Apparatus of the above outlined character are disclosed, for example, in German Offenlegungsschrift No. 32 21 153 and in German Offenlegungsschrift No. 32 31 427. In each of these previously disclosed apparatus, the core for the accumulation of a roll of convoluted sheets and the core for the other end of the band are distant from one another and thus contribute to space requirements of the apparatus. This creates problems not only when the apparatus is permanently installed in a newspaper making plant or the like but also in mobile apparatus or in apparatus wherein the roll of convoluted sheets must or can be transported to storage or elsewhere.

OBJECTS AND SUMMARY OF THE INVENTION

An object of the invention is to provide an apparatus which can store large or small rolls of convoluted paper sheets or the like and whose space requirements are much more modest than those of conventional apparatus.

Another object of the invention is to provide an apparatus wherein the mutual positions of the cores for the two ends of the flexible band which holds the sheets in the form of a roll are selected and maintained in a novel and improved way.

A further object of the invention is to provide the apparatus with novel and improved means for guiding the band between the two cores.

An additional object of the invention is to provide the apparatus with novel and improved means for transmitting torque and/or braking force to the cores.

Still another object of the invention is to provide the apparatus with novel and improved means for rotating the roll of convoluted sheets on one of the cores.

The invention resides in the provision of an apparatus for converting a succession of sheets into a roll of convoluted sheets. The improved apparatus comprises axially spaced apart first and second rotary cores, an elongated band the first and second end portions of which are connected to the respective cores and which includes an elongated intermediate portion between the two end portions, guide means (e.g., a set of pulleys or sheaves) for directing a part of the intermediate portion of the band substantially tangentially of the first core, means for rotating the first and second cores independently of each other so that each of the two cores winds the band therearound while rotating in the proper direction (to collect the band), and means (e.g., including one or more endless belt or band conveyors) for supplying the sheets onto the intermediate portion of the band so that the sheets are confined between the convolutions of the band and the first core. The two cores are preferably mounted in a common frame and are preferably coaxial with each other.

The rotating means can comprise a shaft which is journalled in the frame and rotatably supports the first core while being rigidly connected to the second core. Such rotating means further comprises first and second torque transmitting means (e.g., in the form of spur gears) for the shaft and the first core, respectively. Such gears can be driven by discrete motors each of which can serve as a means for transmitting torque to the respective gear or as a means for braking the respective gear.

Alternatively or in addition to the aforedescribed parts, the rotating means can comprise an endless flexible conveyor which serves to transmit torque to the first core. Such flexible conveyor then includes a portion which engages the periphery of the first core in the absence of convoluted sheets on the first core and which engages the convoluted sheets when the first core is rotated in a direction to collect the band and the sheets which are fed to the intermediate portion of the band. The first core is preferably rotatable about an at least substantially horizontal axis and the conveyor of the rotating means can engage the first core at a level above or below such horizontal axis. In either event, the apparatus can comprise a fluid-operated motor or other suitable means for urging the conveyor against the first core or against a roll of sheets on the first core with a variable force.

The apparatus can further comprise an elongated rocker and means for pivotably supporting the rocker for angular movement about an axis which is at least substantially parallel to and is remote from the axis of the first core. The means for feeding sheets into the range of the band then comprises an endless flexible conveyor which is trained over or is otherwise mounted on the rocker and serves to contact the first core or the roll of convoluted sheets on the first core. Means is provided for pivoting the rocker relative to the first core. The guide means preferably includes a guide member (e.g., one of the aforementioned pulleys or sheaves) which is disposed between the aforesaid part of the intermediate portion of the band and the first core, and the rocker has an end portion in the region of the first core. The rocker and the conveyor thereon intersect the path of the band between the one guide member and the first core irrespective of the number of band convolutions on the first core. This ensures predictable delivery of sheets to the first core or predictable removal of sheets from the roll on the first core, depending on the direction in which the first core is rotated.

The feature that the two cores are axially spaced apart from one another and are preferably coaxial contributes to compactness of the improved apparatus.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
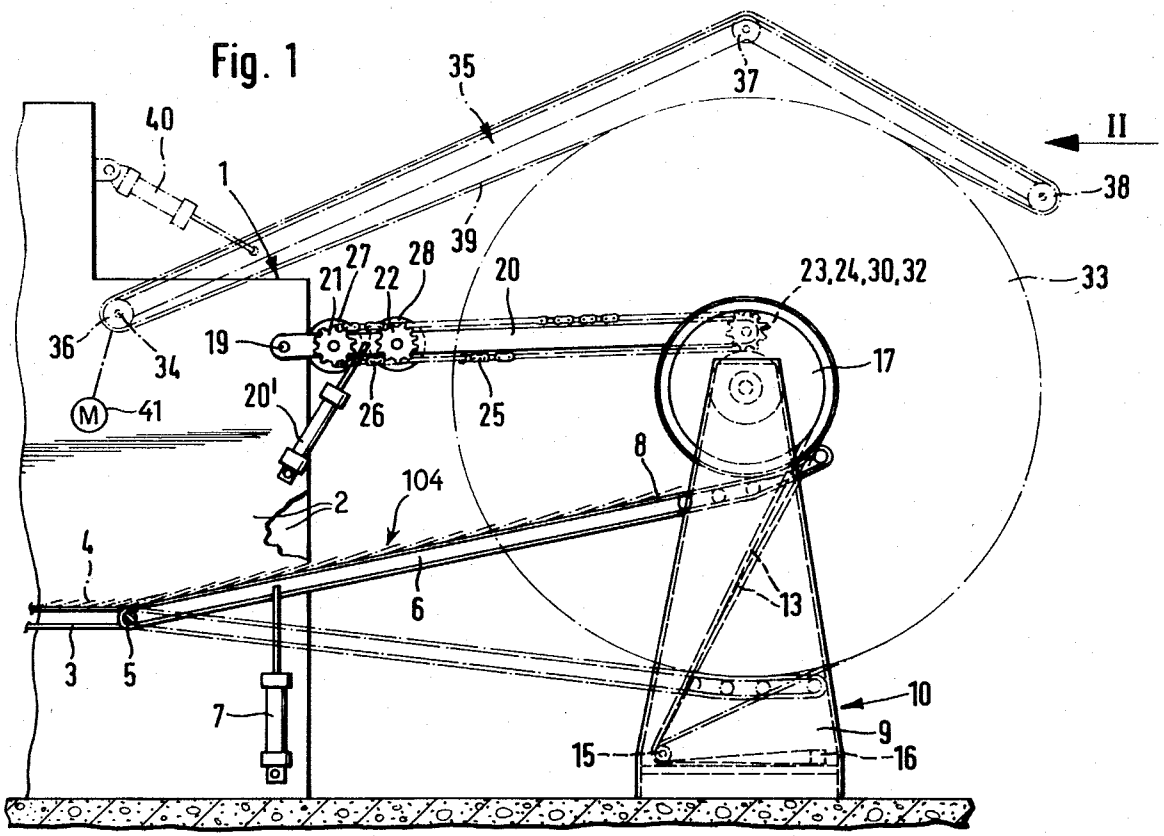
FIG. 1 is a schematic elevational view of an apparatus which embodies one form of the invention and a fragmentary schematic elevational view of a machine which turns out the sheets.

In FIG. 1, the reference character 1 denotes the junction between the improved apparatus and a magazine for storage of sheets 4 or groups of sheets which are to be temporarily stored in the form of a roll 33. The magazine can form part of a newspaper printing plant and the sheets 4 which are to be temporarily stored in the improved apparatus can constitute sections of newspapers, for example, the insets which are to be introduced into partially assembled newspapers at a location other than in the apparatus of the present invention, for example, in a stuffing machine of the type disclosed in commonly owned U.S. Pat. No. 4,116,427 granted to Hans Müller.

A belt conveyor 3 is installed between two spaced-apart cheeks 2 to serve as a means for delivering sheets 4 to or for transporting sheets away from the improved apparatus. The sheets 4 which are supplied by the upper reach of the conveyor 3 form a scalloped stream 104 wherein the neighboring sheets partially overlap each other. In the illustrated embodiment, the leading edge of each next-following sheet 4 partially overlaps the trailing edge of the respective preceding sheet.

A horizontal shaft 5 which is mounted between the two cheeks 2 at the discharge end of the conveyor 3 pivotably supports one end portion of an elongated rocker 6 which constitutes a one-armed lever and supports an endless belt or band conveyor 8. The upper reach of the conveyor 8 receives successive increments of the stream 104 of partially overlapping sheets 4 from the upper reach of the conveyor 3. The conveyor 8 can be said to constitute an extension of the conveyor 3 except that the upper reach of the conveyor 8 is pivotable relative to the upper reach of the conveyor 3 with reference to the axis of the shaft 5. The rocker 6 can be pivoted by a fluid-operated motor 7.

Figure 2:
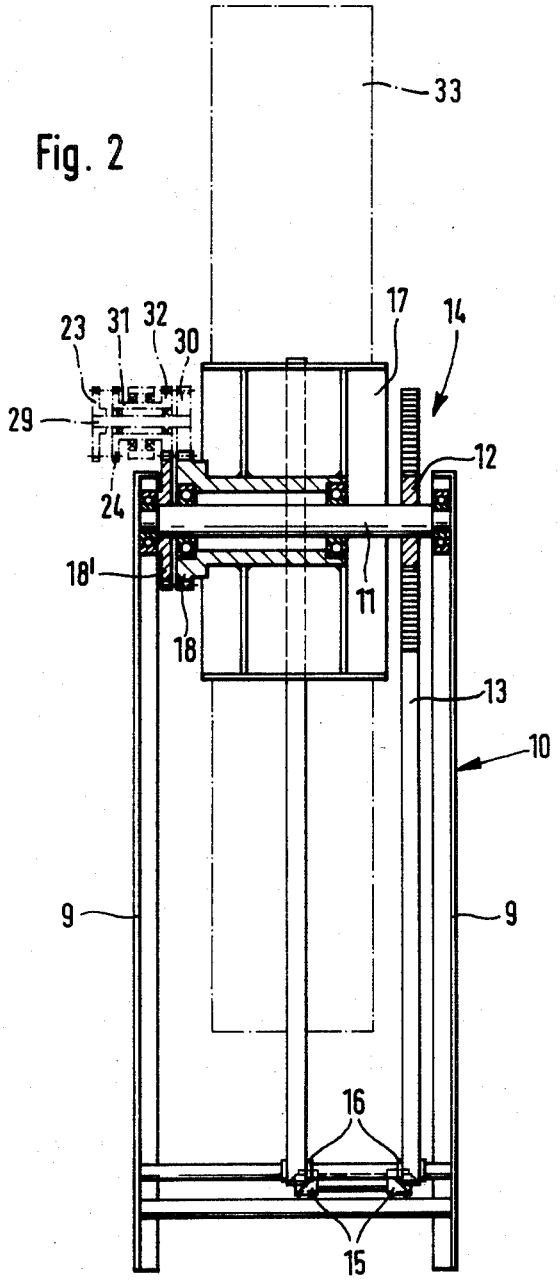
FIG. 2 is an end elevational view as seen in the direction of arrow II in FIG. 1.

The frame 10 of the improved apparatus comprises two spaced-apart parallel upright sidewalls 9 which are rigidly connected to each other in any suitable way so that the frame constitutes a stable support for the roll 33. The upper end portions of the sidewalls 9 support a transversely extending horizontal shaft 11 which is parallel to the shaft 5 and is rigidly connected with a core 12 for one end portion of an elongated flexible band or belt 13. The arrangement is such that the core 12 shares all angular movements of the shaft 11. FIG. 2 shows that the core 12 supports a supply or roll 14 of convoluted band 13.

In the illustrated embodiment of the apparatus, the core 12 for the roll 14 of convoluted band 13 is axially spaced apart from and coaxial with a core 17 for the roll 33. Since the band 13 must be wound onto the core 17 when the latter is to gather a growing roll 33 of sheets 4, the apparatus further comprises guide means in the form of pulleys or sheaves 15 and 16 which change the direction of movement of the intermediate portion of the band 13 between the cores 12 and 17 several times so that the intermediate portion can be convoluted onto the core 17 midway between the axial ends of this part (see FIG. 2). It will be noted that the width of the band 13 (and hence the axial length of the core 12) can be a small fraction of the axial length of the core 17. The two ends of the band 13 are respectively secured to the cores 12 and 17.

The core 17 is free to rotate on the shaft 11 for the core 12 and receives torque from a drive including a gear 18. This gear is adjacent to and is rigid with that axial end of the core 17 which is remote from the core 12. The shaft 11 is rigidly connected with a coaxial gear 18′ which can rotate relative to the gear 18, i.e., the apparatus comprises separate drive means for the cores 12 and 17.

The cheeks 2 further support an additional horizontal shaft 19 which is disposed at a level above the shaft 5 and pivotably supports a lever 20. The latter is pivotable by a suitable hydraulically or pneumatically operated cylinder and piston unit 20′ whose cylinder is articulately connected to at least one of the cheeks 2 and whose piston rod is articulately connected to the lever 20. The rocker 6 and the lever 20 are pivotable in a vertical plane between the cheeks 2.

The lever 20 supports two sprocket wheels 21 and 22 which are mounted thereon at different distances from the shaft 19. That end portion of the lever 20 which is remote from the shaft 19 carries two coaxial sprocket wheels 23 and 24. A first endless chain 25 is trained over the sprocket wheels 21, 23 and a second endless chain 26 is trained over the sprocket wheels 22, 24. The sprocket wheels 21, 22 are respectively driven by discrete combined torque transmitting and braking motors 27 and 28.

The shaft 29 of the sprocket wheel 23 carries a gear 30 which is arranged to rotate with the parts 29 and 23. The shaft 29 further rotatably supports a hollow shaft or sleeve 31 which is rigid and coaxial with the sprocket wheel 24 as well as with a further gear 32. The gear 30 rests on and meshes with the gear 18, and the gear 32 rests on and meshes with the gear 18′. Thus, the motors 27, 28 can drive the cores 17 and 12 independently of each other. It will be noted that, by the simple expedient of actuating the fluid-operated motor 20′ for the purpose of pivoting the lever 20 about the axis of the shaft 19, the operator or an automatic system can move the gears 30, 32 into mesh with or out of mesh with the respective gears 18 and 18′ for the cores 17 and 12. The motors 27, 28 and the means for transmitting motion between such motors and the cores 17, 12 can be said to constitute a means for imparting predetermined movements (acceleration, deceleration or rotation at a constant speed) to the respective cores.

The operation is as follows:

One end of the band 13 is affixed to the core 17 and the other end of this band is affixed to the core 12. The frame 10 is moved to the position of FIG. 1. In the next step, the fluid-operated motors 7 and 20′ are actuated so that the upper reach of the conveyor 8 on the rocker 6 extends tangentially of the core 17 and the lever 20 moves the gears 30 and 32 into mesh with the gears 18 and 18′, respectively. In the next step, the motor 27 is caused to rotate the core 17 in a counterclockwise direction, as viewed in FIG. 1, and the drive for the conveyor 3 is started to advance the stream 104 of sheets 4 in a direction toward the upper reach of the conveyor 8. The upper reach of the conveyor 8 is driven in the same direction as and at the speed of the upper reach of the conveyor 3 so that the stream 104 advances along the upper side of the rocker 6 and toward the core 17. The speed at which the rotating core 17 draws the band 13 off the roll 14 on the core 12 is the same as the speed of the conveyors 3 and 8. The upper reach of the conveyor 8 and the band 13 cross each other in the region between the pulley or sheave 15 (namely that pulley which is nearest to the core 17) and the growing roll 33 of sheets 4 and convolutions of the band 13 on the core 17. The speed of the motor 28 is a function of the speed of the conveyors 3 and 8, and this motor drives the core 17 through the medium of the sprocket wheels 22, 24 and gear 30 at a constant speed whereby the core 12 pays out the band 13, i.e., the diameter of the roll 14 decreases while the diameter of the roll 33 increases. Successive sheets 4 of the scalloped stream 104 engage the left-hand side of the advancing band 13, as viewed in FIG. 1, and are deflected toward the periphery of the core 17 and more particularly toward the outermost convolution of the band 13 on the core 17 and the corresponding convolution consisting of a length of the stream 104 whose sheets 4 are held on the core 17 by the outermost convolution of the band.

The motor 7 yieldably resists clockwise pivoting of the rocker 6 (as viewed in FIG. 1) in response to growing diameter of the roll 33 so that the upper reach of the conveyor 8 continues to cross that portion of the band 13 which advances from the pulley or sheave 15 toward the core 17. This ensures that the oncoming sheets 4 are transferred from the conveyor 8 onto the band 13 and are converted into successive increments of the outermost convolution of the stream 104 on the core 17.

During rotation of the core 17 in a direction to collect the band 13, the motor 27 acts as a brake by opposing withdrawal of the band 13 from the roll 14 on the core 12.

When the diameter of the roll 33 on the core 17 reaches a preselected maximum value, the motor 7 is actuated to pivot the rocker 6 clockwise, and the motor 20' is actuated to pivot the lever 20 counterclockwise, as viewed in FIG. 1, so that the frame 10 and the roll 33 of sheets 4 thereon can be transported to another location. For this purpose, the frame 10 can be mounted on wheels or skids (not shown) or it may be mounted on a conveyor which can be actuated to transport the frame 10 to storage or to another destination, e.g., to a further processing station for sheets 4.

If the sheets 4 which form part of the roll 33 are to be removed from the core 17, e.g., for introduction into a newspaper stuffing machine, the frame 10 is returned to the position of FIG. 1 and the motor 7 is actuated to pivot the rocker 6 in a counterclockwise direction so that the upper reach of the conveyor 8 intersects the band 13 between the core 17 and the pulley or sheave 15. The motor 20' is actuated to pivot the lever 20 in a clockwise direction so as to move the gears 30, 32 into mesh with the respective gears 18 and 18'. The motor or motors for the conveyors 3 and 8 are thereupon started in the opposite direction so that the upper reach of the conveyor 8 travels in a direction to the left, as viewed in FIG. 1, the same as the upper reach of the conveyor 3. The motor 27 is started to drive the shaft 11 in a direction such as to enable the core 12 to collect the band 13 thereon, i.e., the diameter of the roll 14 grows while the diameter of the roll 33 decreases. The successively released sheets 4 come to rest on the upper reach of the conveyor 8 and are transported toward and onto the conveyor 3. The motor 28 brakes the core 17 while the diameter of the roll 33 decreases so as to maintain the band 13 under requisite tension.

When the supply of stored sheets 4 is exhausted, the apparatus is ready for the next use (renewed storage of sheets 4) without any alterations except that the direction of movement of the conveyors 3 and 8 is reversed, the motor 28 is set to drive the core 17 in a direction to collect the band, and the motor 27 is driven in a direction and at a speed to yieldably oppose the core 12 from paying out the band 13.

If desired, the gear 18' can be mounted on and attached to the shaft 11 at the right-hand axial end of the core 17, as viewed in FIG. 2. In such modified apparatus, the shaft 19 supports two discrete levers 20 one of which carries the sprocket wheels and the chain for transmission of motion to the gear 18 and the other of which carries the sprocket wheels and the chain for transmission of motion to the gear 18'. The motors 27 and 28 are then mounted on the respective discrete levers.

It is also possible to omit the motor 28 and the sprocket wheels 22, 24 with the chain 25 and to use the conveyor 8 as a means for rotating the core 17 and the roll 33. All that is necessary is to design the motor 7 in such a way that it can urge the rocker 6 in a counterclockwise direction with a force which suffices to ensure that the frictional engagement between the upper reach of the conveyor 8 and the core 17 or the outermost convolution of the band 8 suffices to rotate the core 17 and the roll 33 in a counterclockwise direction, as viewed in FIG. 1, when the conveyers 3 and 8 are driven in a direction to deliver sheets 4 to the roll 33.

Still further, and if the apparatus of FIGS. 1 and 2 is designed to constitute exclusively a means for converting the band 13 and the stream 104 of sheets 4 into a roll 33, the motor 27 can be replaced with a simple or complex brake which need not perform any torque-transmitting function. Analogously, if the apparatus is designed for the sole purpose of transporting sheets 4 from storage (roll 33) to a newspaper stuffing machine or the like, the motor 28 can be replaced with a simple or complex brake which need not perform any torque-transmitting function.

FIG. 1 further shows, by phantom lines, a further embodiment of the drive means for rotating the core 17 and the roll 33. Such drive means can be used in lieu of or in addition to the motor 27, sprocket wheels 21, 23 and chain 25. This modified drive includes a substantially inverted V-shaped carriage or support 35 the left-hand end portion of which is pivotable about the axis of a horizontal shaft 34 between the cheeks 2. The carrier 35 supports a set of deflecting rollers 36, 37, 38 which constitute pulleys for an endless belt or band conveyor 39. The roller or pulley 36 is driven by a motor 41 whose speed is synchronized with that of the motor means for the conveyors 3 and 8 in such a way that the speed of the conveyors 3, 8 matches that of the conveyor 39. The conveyor 39 engages the core 17 or the external surface of the roll 33 on the core 17. In order to ensure that the conveyor 39 will bear against the core 17 or against the roll 33 with a required force to ensure predictable rotation of these parts, the apparatus can further comprise means 40 (e.g., a pneumatically operated cylinder and piston unit) for biasing the conveyor 39 against the core 17 or against the roll 33, i.e., for biasing the carrier 35 in a clockwise direction, as viewed in FIG. 1. The cylinder of the biasing means 40 is pivotally connected to at least one of the cheeks 2 or to another stationary part, and the piston rod of the biasing means 40 is articulately connected to the carrier 35. The biasing means 40 can further serve as a means for lifting the conveyor 39 off the roll 33, e.g., preparatory to transport of the frame 10 to a different location or when the core 17 is to be rotated by the motor 27.

An important advantage of the improved apparatus is its compactness and simplicity. The entire apparatus can be readily shifted or transported between different locations of use, and the apparatus is designed in such a way that it requires a minimum of stationary clutches or like components. Furthermore, the guide means 15, 16 ensure that the band 13 is properly convoluted onto or paid out by the core 17 even though this core is coaxial with the core 12 for the band 13. Since the upper reach of the conveyor 8 intersects the path of the band 13 between the pulley 15 and the core 17 in each and every angular position of the rocker 6, the apparatus can invariably deliver sheets 4 to or receive sheets from the core 17 irrespective of the diameter of the roll 33. The rocker 6 is pivotable in a vertical or nearly vertical plane and the force with which its conveyor 8 bears against the core 17 or against the external surface of the roll 33 is adjustable by the motor 7 for the aforedescribed reasons, i.e., to ensure that the roll 33 will be rotated at the required speed if the means for rotating the roll 33 is or includes the conveyor 8.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for converting a succession of sheets into a roll of convoluted sheets, comprising axially spaced apart first and second rotary cores; an elongated band having first and second end portions connected to the respective cores and an intermediate portion; guide means for directing a part of said intermediate portion substantially tangentially of said first core; means for rotating said cores independently of one another so that each of said cores winds the band therearound while rotating in a direction to collect the band; and means for supplying the sheets onto said intermediate portion of the band while said first core rotates in a direction to collect the band so that the sheets are confined between the convolutions of the band on said first core.

2. The apparatus of claim 1, further comprising common frame means for said cores.

3. Apparatus according to claim 2, wherein said first core is coaxial with said second core.

4. The apparatus of claim 3, wherein said rotating means comprises a shaft which is journalled in said frame and rotatably supports said first core, said second core being arranged to share the angular movements of said shaft and said rotating means further comprising first and second torque transmitting means for said shaft and said first core, respectively.

5. The apparatus of claim 1, wherein said rotating means comprises an endless flexible conveyor arranged to transmit torque to said first core.

6. The apparatus of claim 5, wherein said flexible conveyor includes a portion which engages the periphery of said first core in the absence of convoluted sheets and engages the convoluted sheets when said first core is rotated in a direction to collect the band and the sheets which are fed to said intermediate portion of the band.

7. The apparatus of claim 5, wherein said first core is rotatable about a substantially horizontal axis and said conveyor engages the first core or the convoluted sheets thereon at a level above such axis.

8. The apparatus of claim 7, further comprising means for urging said conveyor against said first core with a variable force.

9. The apparatus of claim 1, further comprising an elongated rocker, means for pivotably supporting the rocker for angular movement about an axis which is at least substantially parallel to and remote from the axis of said first core, an endless flexible conveyor mounted on said rocker and arranged to contact said first core, and means for pivoting said rocker relative to said first core.

10. The apparatus of claim 9, wherein said guide means includes a guide member which is disposed between said part of said intermediate portion and said first core and said rocker includes an end portion in the region of said first core, said rocker intersecting the path of the band between said guide member and said first core irrespective of the number of band convolutions on said first core.

* * * * *